US008082610B2

(12) United States Patent
Henry et al.

(10) Patent No.: US 8,082,610 B2
(45) Date of Patent: Dec. 27, 2011

(54) SHOWERHEAD ASSEMBLY WITH WATER FLOW DIVERTER

(76) Inventors: Mang Hoi Kwan Henry, Hong Kong (CN); Mang Loi Shang, Hong Kong (CN)

( * ) Notice: Subject to any disclaimer, the term of this patent is extended or adjusted under 35 U.S.C. 154(b) by 1021 days.

(21) Appl. No.: 11/999,311

(22) Filed: Dec. 4, 2007

(65) Prior Publication Data

US 2008/0250556 A1 Oct. 16, 2008

(30) Foreign Application Priority Data

Apr. 11, 2007 (CN) ..... 2007 2 0119495 U

(51) Int. Cl.
*A47K 3/022* (2006.01)

(52) U.S. Cl. ..... 4/601; 4/610; 4/615; 239/587.2

(58) Field of Classification Search ..... 4/601, 615, 4/610; 239/587.2
See application file for complete search history.

(56) References Cited

U.S. PATENT DOCUMENTS

| | | | | |
|---|---|---|---|---|
| 743,623 | A * | 11/1903 | Dinneen | 4/601 |
| 6,442,775 | B1 * | 9/2002 | Gransow et al. | 4/601 |
| 6,813,787 | B2 * | 11/2004 | Rosenberg | 4/601 |
| 7,356,857 | B2 * | 4/2008 | Rosenberg | 4/601 |
| 2002/0035752 | A1 * | 3/2002 | Gransow et al. | 4/601 |
| 2006/0059616 | A1 * | 3/2006 | Grohe | 4/615 |

* cited by examiner

*Primary Examiner* — Huyen Le
*Assistant Examiner* — Lauren Heitzer
(74) *Attorney, Agent, or Firm* — Raymond Y. Chan; David and Raymond Patent Firm

(57) ABSTRACT

A showerhead assembly includes a water adapter and a water flow diverter. The water adapter includes two rotatable frames having a first water outlet and a second water inlet respectively and a supporting frame, having a first water inlet communicating with the first water outlet and a second water outlet, rotatably coupled between the rotatable frames. The water flow diverter contains a first water opening communicating with the first water outlet, a second water opening communicating with the second water inlet, and a water exit. The water flow diverter is adapted for selectively controlling the water flow at one of the conditions including the water flowing out at the second water outlet only, the water flowing out at the water exit only, and the water flowing out at both the second water outlet and the water exit at the same time.

8 Claims, 7 Drawing Sheets

SHOWERHEAD ASSEMBLY WITH WATER FLOW DIVERTER

BACKGROUND OF THE PRESENT INVENTION

1. Field of Invention

The present invention relates to a bathroom equipment, and more particularly to a showerhead assembly with a water flow diverter.

2. Description of Related Arts

According to the hotel bathroom design for most countries, such as United States, Canada, or Australia, the water outlet for connecting to a showerhead is located on the wall about 1.75 meters to 2.2 meters away from the ground to fit the height of the hotel customers. Generally speaking, the water outlet includes an arc-shaped water conduit protruding from the wall, wherein the water conduit is connected to a water pipe which is embedded into the wall. Therefore, the designer will not install any showerhead adjusting frame into the frame because the water pipe behind the wall will be damaged when the drilling holes are formed on the wall by driller. In other words, the designer will only mount a hand showerhead being detachably hung at the water outlet. Taking this into consideration, the inventor invents a showerhead assembly for supporting at the water conduit to height-adjustably support the showerhead without damaging the structure of the wall surface. Thus, the showerhead assembly is easy to install into any exiting water outlet. By selectively adjusting the position of the showerhead, a user, such as a child, is able to lower the position of showerhead with respect to the height of the user. Therefore, the present invention is adapted to achieve the above mentioned goals and to increase the enjoyment of showering.

SUMMARY OF THE PRESENT INVENTION

A main object of the present invention is to provide a showerhead assembly with a water flow diverter, which overcomes all of the existing problems including incapable of supporting dual showerheads, incapable of height-adjusting the position of the showerhead, and incapable of mounting the showerhead without any pre-drilled hole.

Accordingly, in order to accomplish the above object, the present invention provides a showerhead assembly, which comprises a water adapter which comprises a supporting frame having a first water inlet for coupling with a water source and a second water outlet coupling with a stationary showerhead, first and second rotatable frames rotatably coupling with two end sides of the supporting frame via a supporting shaft, wherein the first rotatable frame has a first water outlet and the second rotatable frame has a second water inlet.

Accordingly, the supporting shaft is extended from the first rotatable frame to the second rotatable frame through the supporting frame via two sealing units, wherein each sealing unit comprises a shaft sleeve and two sealing rings coaxially mounted at the supporting shaft to securely couple and seal the respective rotatable frame with the supporting frame. The supporting shaft has one enlarged end engaged with the first rotatable frame and a free end securely engaged with a locking nut at the second rotatable frame.

Accordingly, each of the shaft sleeves has a hollow cone shape that an outer circumferential size is gradually increasing from the supporting frame towards the respective rotatable frame.

The supporting frame of the water adapter further comprises a first blocking wall positioned adjacent to the first water inlet and a second blocking wall positioned adjacent to the second water outlet. The first blocking wall blocks the water flowing from the first water inlet to the first water outlet. The second blocking wall blocks the water flowing from the second water inlet to the second water outlet.

The showerhead assembly further comprises a water flow diverter and first and second water conduits. The water flow diverter contains first and second water openings, and a water exit. The first water conduit is communicatively connected between the first water outlet of the water adapter and the first water opening of the water flow diverter. The second water conduit is communicatively connected between the second water inlet of the water adapter and the second water opening of the water flow diverter. Accordingly, the water is controllably guided to flow to the second water outlet of the water adapter or the water exit of the water flow diverter.

According to the preferred embodiment, the water is controllably guided to flow to the second water outlet of the water adapter and the water exit of the water flow diverter at the same time.

The present invention provides the showerhead assembly for dual showerhead support, so as to control the water flowing to the stationary showerhead and the adjustable showerhead. The water adapter is adapted to guide the water flowing at one direction only that the water is guided to flow from the water adapter to the water flow diverter through the first water conduit and the water is guided to flow back to the water adapter from the water flow diverter through the second water conduit. In other words, the water is firstly guided to flow to the water flow diverter in order to further control the water flowing out the water flow diverter and/or the water adapter. Therefore, three different water flow configurations are achieved. In addition, since each of the shaft sleeves has a hollow cone shape, a friction between the shaft sleeve and the corresponding rotatable frame is generated to retain the water flow diverter in different folding positions with respect to the water adapter.

These and other objectives, features, and advantages of the present invention will become apparent from the following detailed description, the accompanying drawings, and the appended claims.

DETAILED DESCRIPTION OF THE PREFERRED EMBODIMENT

Figure 1:
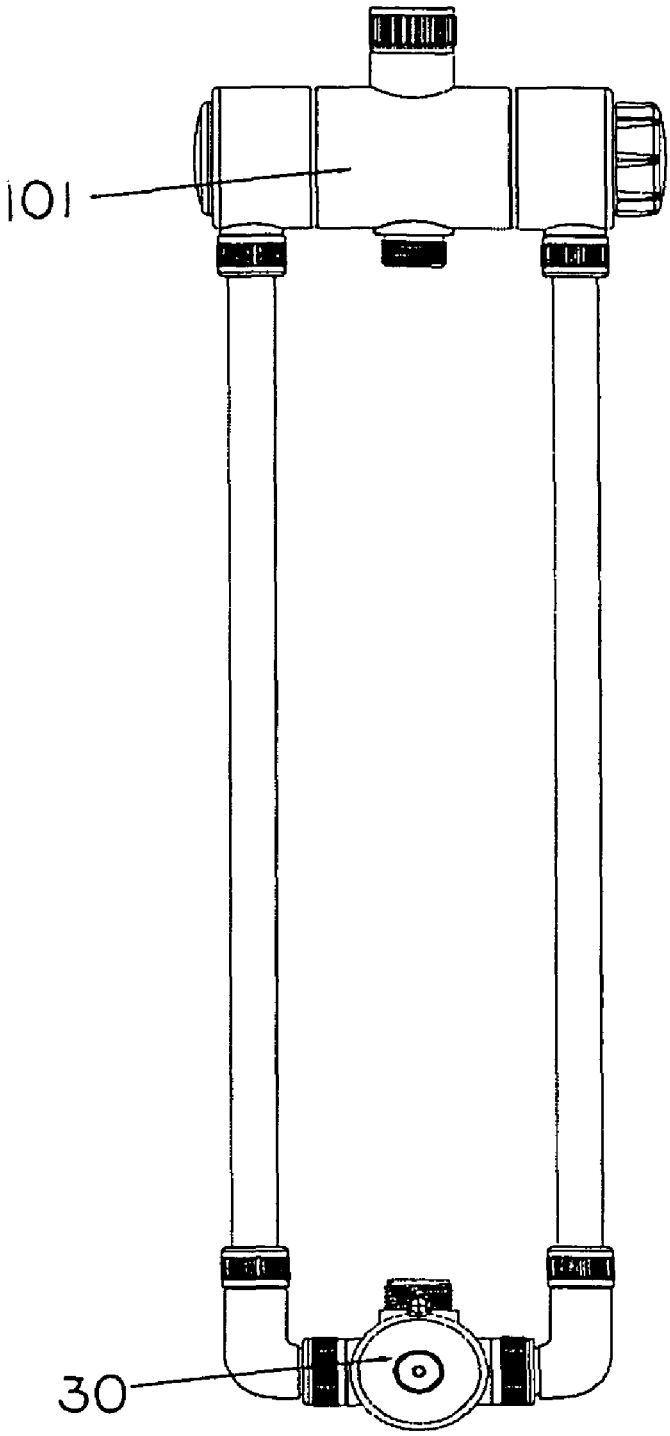
FIG. 1 is a schematic view of a showerhead assembly according to a preferred embodiment of the present invention.

Referring to FIGS. 1 through 5 of the drawings, a showerhead assembly according to a preferred embodiment of the present invention is illustrated, wherein the showerhead assembly comprises a water adapter 101 which comprises a movable unit 11, 12 and an immovable unit, 13, 14, 15, 16, 19, 20, 21. The movable unit comprises two rotatable frames 12, which are positioned at left and right sides of the water adapter 101, wherein one of the rotatable frames 12 has a first water outlet B while another rotatable frame 12 has a second water inlet F. The immovable unit comprises a supporting frame 19 having a first water inlet A for operatively coupling with a main water source and a second water outlet G for operatively coupling with a stationary showerhead. The immovable unit of the water adapter 101 further comprises a supporting shaft 13 extended from one of the rotatable frames 12, (the left rotatable frame), to another rotatable frame 12 (the right rotatable frame) through the supporting frame 19. Two sealing units are coaxially mounted to the supporting shaft 13 to seal the rotatable frames 12 with the supporting frame 19. Each sealing unit comprises a shaft sleeve 14 and two sealing rings 15, 16. In other words, the left shaft sleeve 14 and the two left sealing rings 15, 16 are mounted at the supporting shaft 13 to seal the left rotatable frame 12 with the supporting frame 19 while the right shaft sleeve 14 and the two right sealing rings 15, 16 are mounted at the supporting shaft 13 to seal the right rotatable frame 12 with the supporting frame 19. Accordingly, the supporting shaft 13 has one enlarged end engaged with the left rotatable frame 12 and a free end securely engaged with a locking nut 20 at the right rotatable frame 12.

The rotatable frames 12 are rotatably coupled with two sides of the supporting frame 19 respectively via the supporting shaft 13. The supporting frame 19 further comprises a first blocking wall H positioned adjacent to the first water inlet A and a second blocking wall I positioned adjacent to the second water outlet G. The first blocking wall H blocks the water flowing from the first water inlet A to the first water outlet B. The second blocking wall I blocks the water flowing from the second water inlet F to the second water outlet G. Each of the shaft sleeves 14 has a hollow cone shape that an outer circumferential size is gradually increasing from the supporting frame 19 towards the respective rotatable frame 12 to enhance a surface frictional engagement between the shaft sleeves 14 and the left and right rotatable frames 12.

Figure 2:
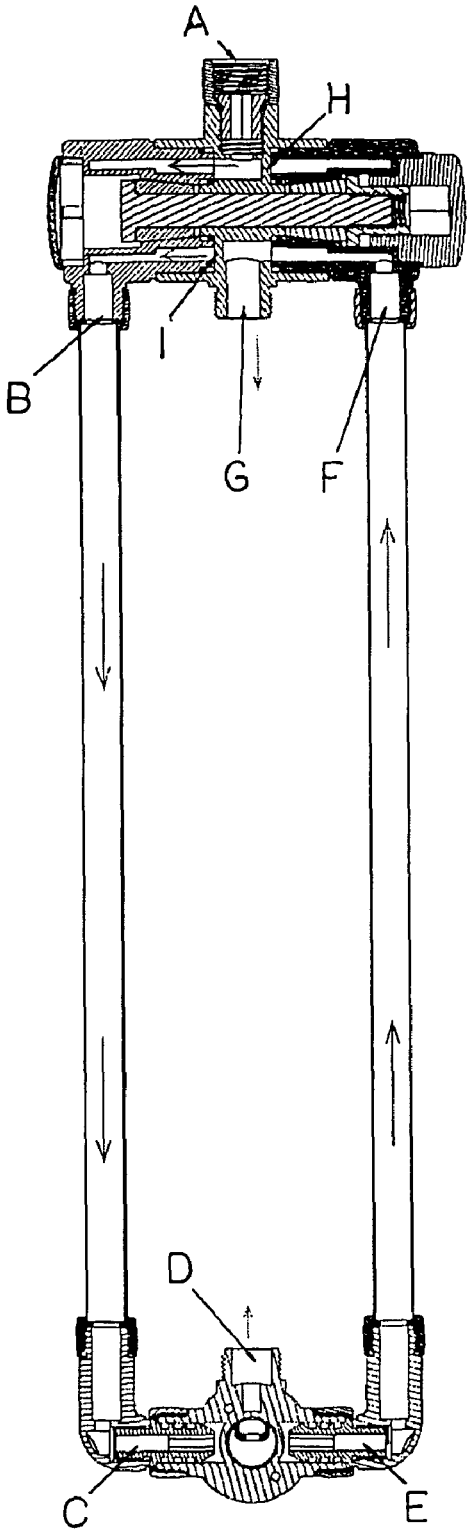
FIG. 2 is a sectional view of the showerhead assembly according to the above preferred embodiment of the present invention, illustrating the water flow direction through the showerhead assembly.

According to the preferred embodiment, the showerhead assembly further comprises first and second water conduits coupling with the water adapter 101 and a water flow diverter 30 coupling with the first and second water conduits. As shown in FIG. 2, the water adapter 101 contains the first water outlet B, the second water outlet G, the first water inlet A, and the second water inlet F. The water flow diverter 30 contains first and second water openings C, E provided at two end sides thereof, and a water exit D provided between the two end sides of the water flow diverter 30 for operatively coupling with an adjustable showerhead. The first water conduit has one end communicatively connected to the first water outlet B of the water adapter 101 and an opposed end rotatably connected to the first water opening C of the water flow diverter 30. The second water conduit has one end communicatively connected to the second water inlet F of the water adapter 101 and an opposed end rotatably connected to the second water opening E of the water flow diverter 30. Accordingly, the water is controllably and selectively guided to flow to the stationary showerhead at the second water outlet G of the water adapter 101 only, or to flow to the adjustable showerhead at the water exit D of the water flow diverter 30 only. Likewise, the water is controllably and selectively guided to flow not only to the stationary showerhead at the second water outlet G of the water adapter 101 but also to the adjustable showerhead at the water exit D of the water flow diverter 30 at the same time. Accordingly, the water flow diverter 30 is arranged to control the direction of the water flow. The water flow diverter 30 controls the direction of the water flowing from the first water opening C to the water exit D or flowing from the first water opening C to the second water opening E, such that the water will only flow to either the stationary showerhead or the adjustable showerhead only. The water flow diverter 30 also controls the direction of the water flowing from the first water opening C to both the water exit D and the second water opening E, such that the water will flow to both the stationary showerhead and the adjustable showerhead. In other words, a switch of the water flow diverter 30 is adapted to controllably actuate at three different positions. The first position of the switch is to close the second water opening and to open the water exit such that the water is only guided to flow out at the water exit. The second position of the switch is to open the second water opening and to close the water exit such that the water is only guided to flow out at the second water opening so as to flow back to the water adapter 101. The third position of the switch is to open both the second water opening and the water exit such that the water is only guided to dividedly flow out at the water exit and the second water opening at the same time. It is worth to mention that the stationary showerhead cannot be height-adjusted the position thereof because the stationary showerhead is coupled with the water adapter 101 at the second water outlet G. The adjustable showerhead can be selectively height-adjusted the position thereof by the pivotally folding movement of the first and second water conduits.

Figure 3:
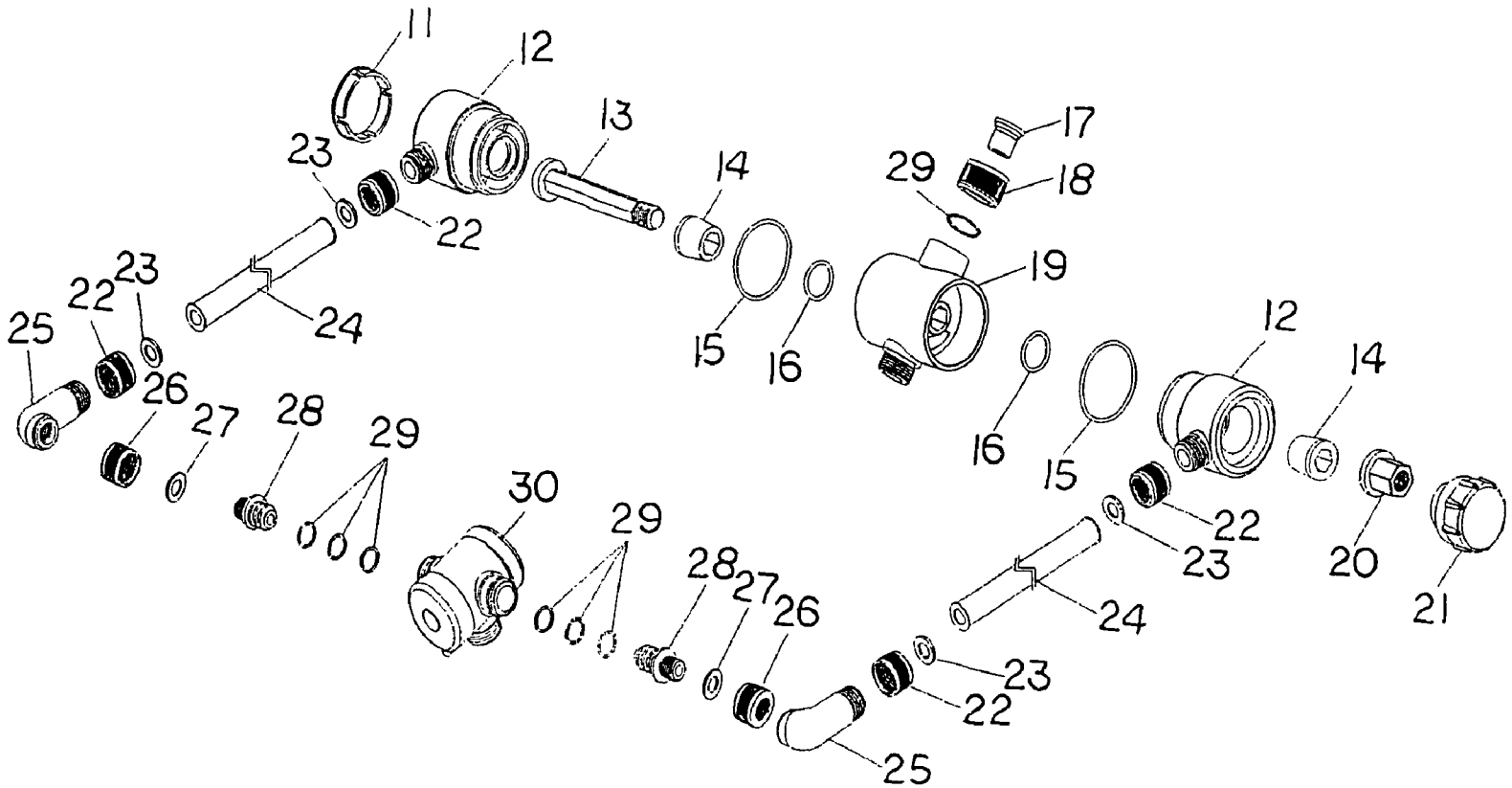
FIG. 3 is an exploded perspective view of the showerhead assembly according to the above preferred embodiment of the present invention.
Figure 4:
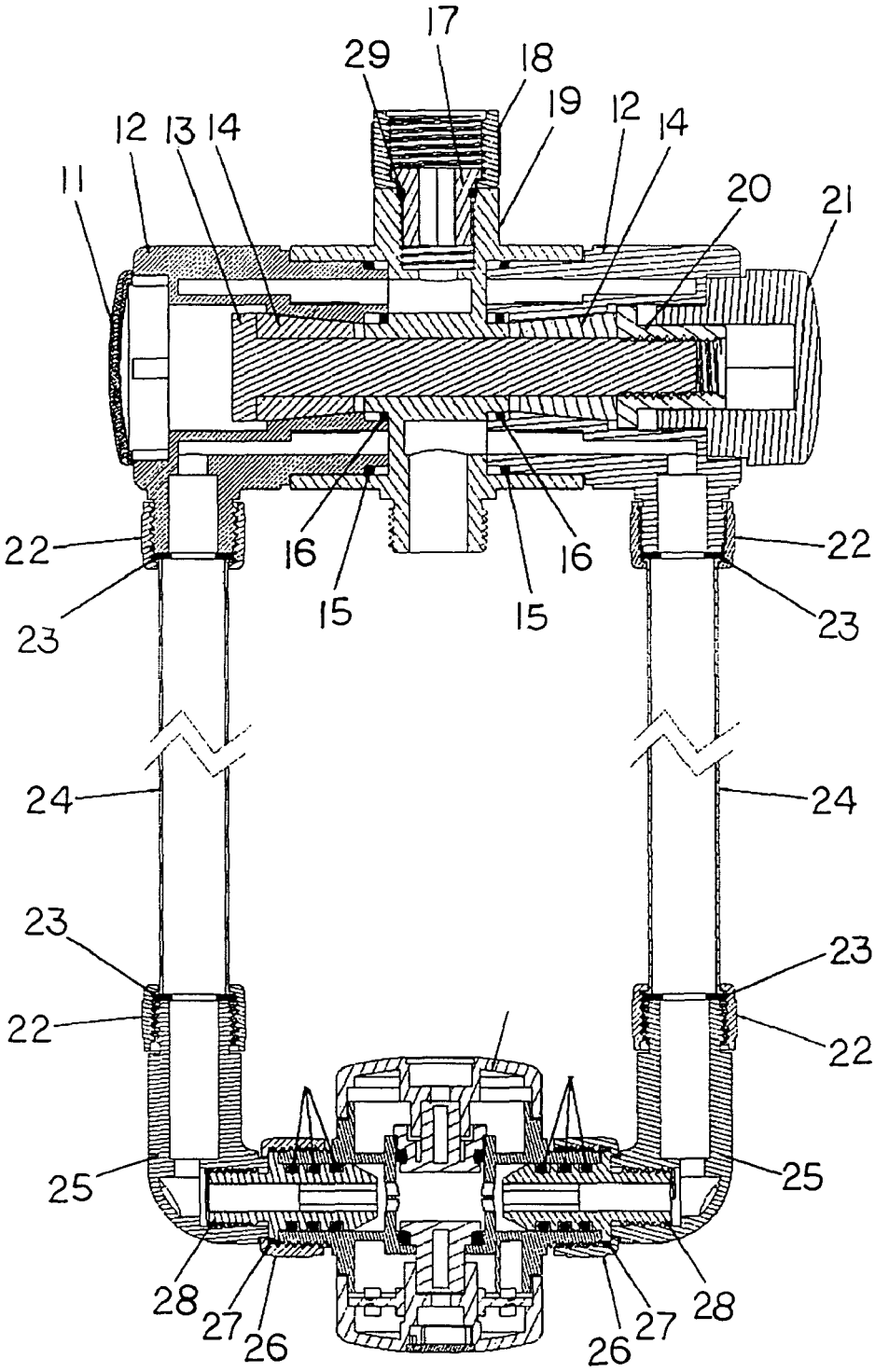
FIG. 4 is a sectional view of the showerhead assembly according to the above preferred embodiment of the present invention.
Figure 5:
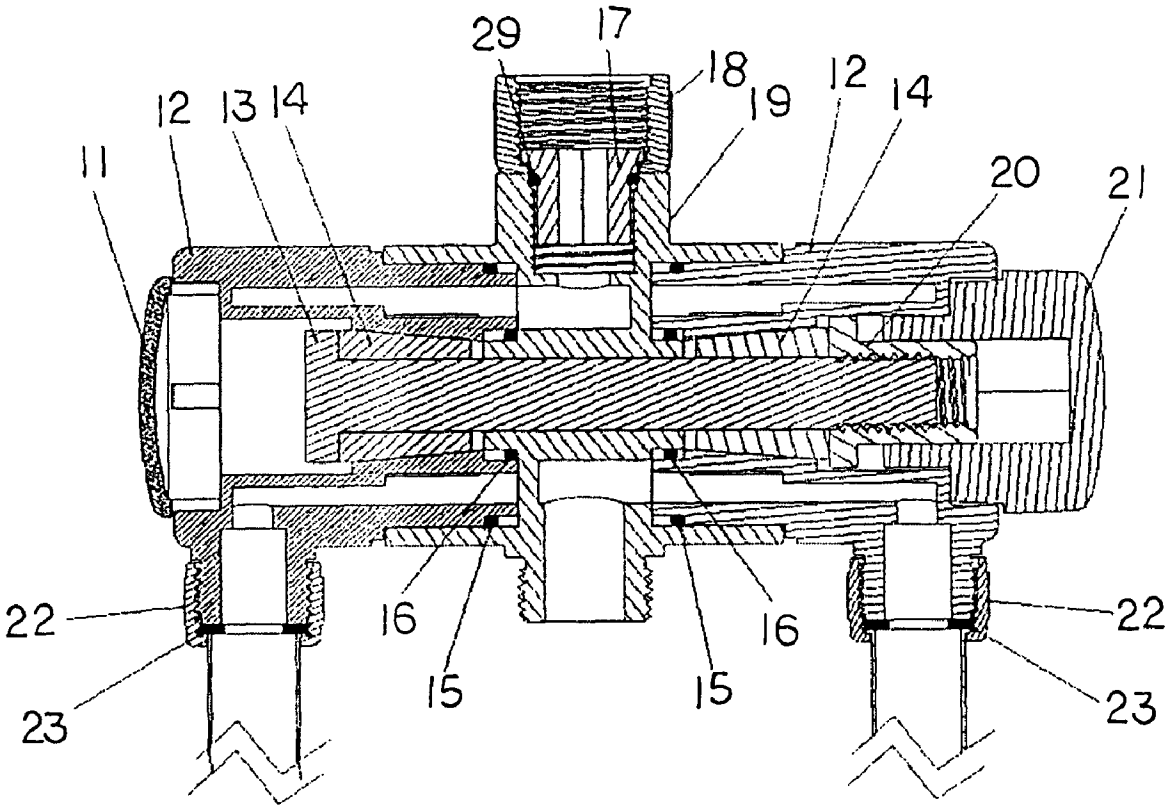
FIG. 5 is a sectional view of the water adapter of the showerhead assembly according to the above preferred embodiment of the present invention.

As shown in FIG. 3, the showerhead assembly further comprises a rotatable cap 11 coupled with the left rotatable frame 12. The supporting shaft 13 extended through the shaft sleeves 14 and the sealing ring 15, 16, wherein the first sealing ring 15 has a size larger than a size of the second sealing ring 16. A water pipe adapter 18 is coupled at the first water inlet A to detachably couple with the water source. An adjusting cap 21 is rotatably coupled with the right rotatable frame 12 to rotatably couple with the supporting shaft 13 through the locking nut 20 so as to adjust the engagement of the supporting frame 19 between the two rotatable frames 12 via the supporting shaft 13. The first and second water conduits have the same structural configuration. The first water conduit comprises a straight water duct 24 coupling with the respective first water outlet B via a tubular adapter 22 with a rubber sealing pad 23, an angled water duct 25 coupling with the straight water duct 24 via another tubular adapter 22 with the rubber sealing pad 23. Another end of the angled water duct 25 is coupled with a connector head 28, wherein the connector head 28 is rotatably coupled at the first water opening C of the water flow diverter 30 via a nut body 28 and a rubber pad 29. In other words, the second water conduit also comprises the straight water duct 24 coupling with the second water inlet F, the angled water duct 25 coupling with the straight water duct 24, and the connector head 28 which is coupling with the angled water duct 25 and is rotatably coupled at the second water opening E.

According to the preferred embodiment, the water is firstly guided to flow to the first water conduit into the water flow diverter 30. The showerhead assembly of the present invention provides a main advantage of selecting three different water configurations: (1) the water flow diverter 30 is adapted to guide the water flowing to the adjustable showerhead at the water flow diverter 30; (2) the water flow diverter 30 is adapted to guide the water flowing back to the water adapter 101 through the second water conduit to the stationary showerhead at the water adapter 101; (3) the water flow diverter 30 is adapted to guide the water flow to both the stationary showerhead and the adjustable showerhead at the same time. It is worth to mention that since the rotatable frames 12 are rotatably coupled with the supporting frame 19, the water flow diverter 30 is adapted to fold between a lower position which is positioned below the water adapter 101, and an upper position which is positioned above the water adapter 101. Therefore, the user is able to adjust the height of the water flow diverter 30 by pivotally folding the first and second water conduits and by rotating the water flow diverter 30 between the first and second water conduits so as to optimize the position of the adjustable showerhead for increasing the enjoyment of showering.

It is worth to mention that the installation of the showerhead assembly of the present invention is extremely simple by coupling the first water inlet A of the water adapter 101 with the water pipe of the water source, such that no pre-drilled hole is formed on the wall surface.

Figure 8:
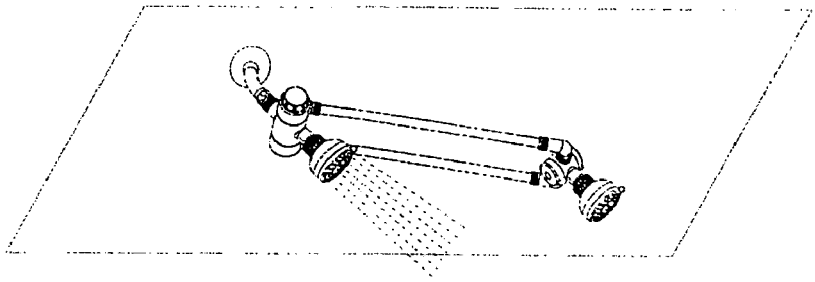
FIG. 8 is a perspective view of the showerhead assembly according to the above preferred embodiment of the present invention, illustrating the water flow being guided via the water flow diverter to flow towards the stationary showerhead while the adjustable showerhead is placed at a lower position.
Figure 7:
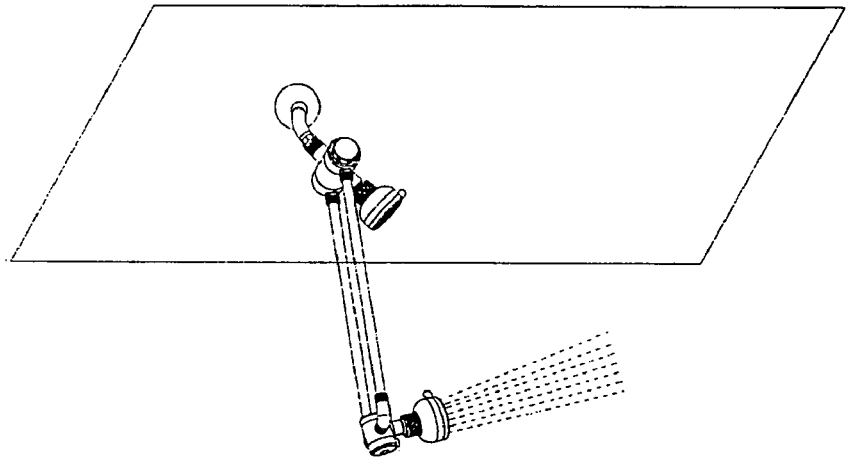
FIG. 7 is a perspective view of the showerhead assembly according to the above preferred embodiment of the present invention, illustrating the water flow being guided via the water flow diverter to flow towards the adjustable showerhead at a higher position.
Figure 6:
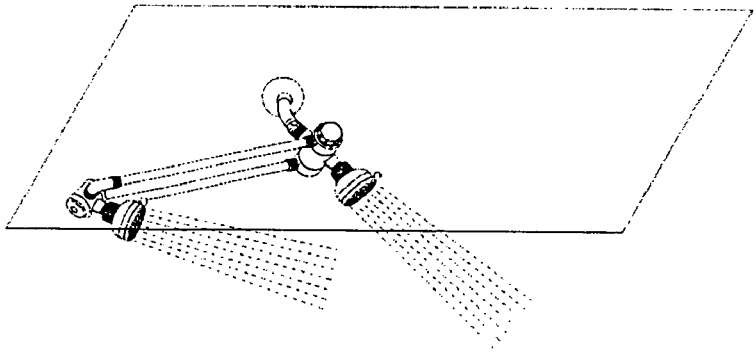
FIG. 6 is a perspective view of the showerhead assembly according to the above preferred embodiment of the present invention, illustrating the water flow being divided via the water flow diverter to flow towards both stationary and adjustable showerheads while the adjustable showerhead is downwardly adjusted from its higher position.
Figure 10:
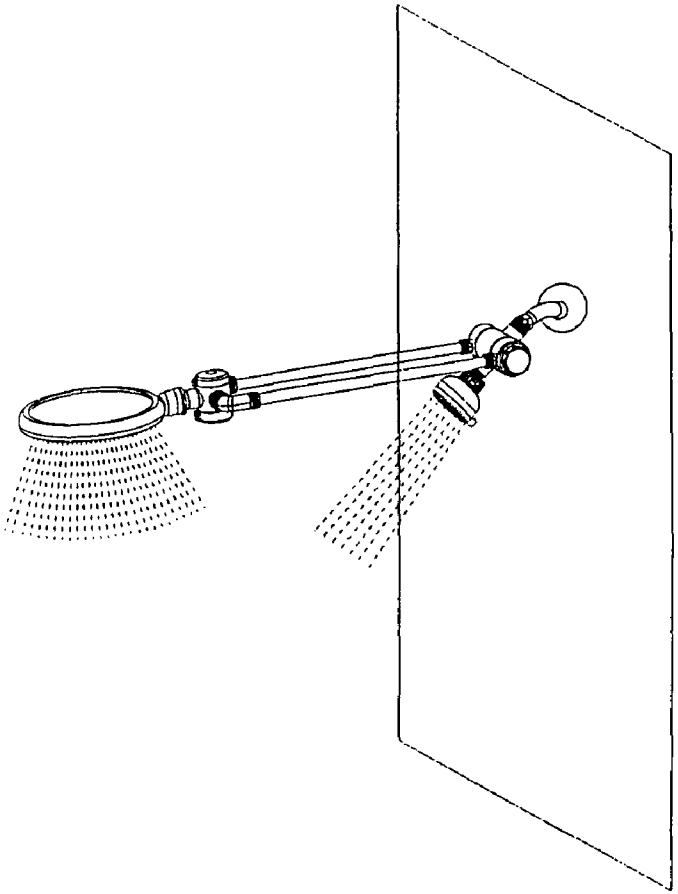
FIG. 10 is a perspective view of the showerhead assembly according to the above preferred embodiment of the present invention, illustrating the water flow being guided via the water flow diverter to flow towards the stationary showerhead while the adjustable showerhead is embodied as a rain drop showerhead.
Figure 9:
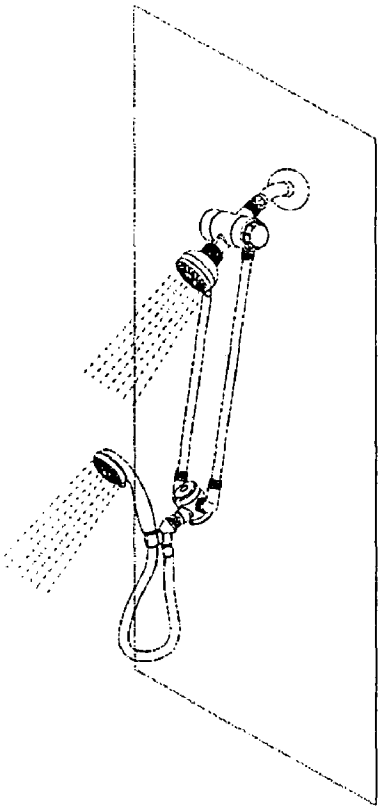
FIG. 9 is a perspective view of the showerhead assembly according to the above preferred embodiment of the present invention, illustrating the water flow being guided via the water flow diverter to flow towards both stationary and adjustable showerheads while the adjustable showerhead is embodied as a hand showerhead with a flexible water pipe.

Accordingly, FIGS. 6 to 10 illustrate the different settings of the showerhead assembly. As shown in FIG. 6, the water flow diverter 30 is upwardly folded above the water adapter 101 at the upper position and is control the water flowing to both the stationary showerhead and the adjustable showerhead. As shown in FIG. 7, the water flow diverter 30 is downwardly folded from its higher position and is control the water flowing to the adjustable showerhead only. As shown in FIG. 8, the water flow diverter 30 is upwardly folded below the water adapter 101 at the upper position and is control the water flowing to the stationary showerhead only. As shown in FIG. 9, the adjustable showerhead is a hand held showerhead connecting to the water flow diverter 30 via a flexible tube. As shown in FIG. 10, the adjustable showerhead is a rain drop showerhead connecting to the water flow diverter 30.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A showerhead assembly, comprising:

a water adapter comprising a supporting frame having a first water inlet for detachably coupling with a water source and a second water outlet for coupling with a stationary showerhead, first and second rotatable frames rotatably coupling with two end sides of said supporting frame, wherein said first rotatable frame has a first water outlet communicating with said first water inlet for guiding a water flowing from said first water inlet to said first water outlet, wherein said second rotatable frame has a second water inlet communicating with said second water outlet for guiding said water flowing from said second water inlet to said second water outlet;

first and second water conduits, wherein said first water conduit has one end communicatively coupling with said first water outlet, wherein said second water conduit has one end communicatively coupling with said second water outlet; and a water flow diverter containing a first water opening communicatively coupling with an opposed end of said first water conduit for guiding said water flowing from said water adapter to said water flow diverter through said first water conduit, a second water opening communicatively coupling with an opposed end of said second water conduit for guiding said water flowing back to said water adapter from said water flow diverter through said second water conduit, and a water exit communicating with said first water opening for coupling with an adjustable showerhead, wherein said water flow diverter is adapted for selectively controlling said water flowing out from at least one of said stationary showerhead and said adjustable showerhead;

wherein said opposed ends of said first and second water conduits are rotatably coupled with said water flow diverter at said first and second water openings respectively, such that said water flow diverter is rotatably folded with respect to said water adapter through said first and second water conduits;

wherein said first and second water openings are provided at two end sides of said water flow diverter while said water exit is provided at said water flow diverter between said first and second water openings;

wherein said supporting frame comprises a first blocking wall positioned adjacent to said first water inlet for blocking said water flowing from said first water inlet to said first water outlet, and a second blocking wall positioned adjacent to said second water outlet for blocking said water flowing from said second water inlet to said second water outlet;

wherein said water adapter further comprises a supporting shaft having an elongated end coupling with said first rotatable frame and a free end which is extended through said supporting frame and is coupled with said second rotatable frame such that said first and second rotatable frames are rotatably coupled with said supporting frame through said supporting shaft.

2. The showerhead assembly, as recited in claim 1, wherein said water adapter further comprises two shaft sleeves which are coaxially coupled with said supporting shaft and are frictionally engaged with said first and second rotatable frames respectively, wherein each of said shaft sleeves has a hollow cone shape that an outer circumferential size is gradually increasing from said supporting frame towards said respective rotatable frame to enhance a frictional engagement between said shaft sleeves and said first and second rotatable frames.

3. A showerhead assembly, comprising:

a water adapter comprising a supporting frame having a first water inlet for detachably coupling with a water source and a second water outlet for coupling with a stationary showerhead, first and second rotatable frames rotatably coupling with two end sides of said supporting frame, wherein said first rotatable frame has a first water outlet communicating with said first water inlet for guiding a water flowing from said first water inlet to said first water outlet, wherein said second rotatable frame has a second water inlet communicating with said second water outlet for guiding said water flowing from said second water inlet to said second water outlet;

first and second water conduits, wherein said first water conduit has one end communicatively coupling with said first water outlet, wherein said second water conduit has one end communicatively coupling with said second water outlet; and a water flow diverter containing a first water opening communicatively coupling with an opposed end of said first water conduit for guiding said water flowing from said water adapter to said water flow diverter through said first water conduit, a second water opening communicatively coupling with an opposed end of said second water conduit for guiding said water flowing back to said water adapter from said water flow diverter through said second water conduit, and a water exit communicating with said first water opening for coupling with an adjustable showerhead, wherein said water flow diverter is adapted for selectively controlling said water flowing out from at least one of said stationary showerhead and said adjustable showerhead;

wherein said opposed ends of said first and second water conduits are rotatably coupled with said water flow diverter at said first and second water openings respectively, such that said water flow diverter is rotatably folded with respect to said water adapter through said first and second water conduits;

wherein said first and second water openings are provided at two end sides of said water flow diverter while said water exit is provided at said water flow diverter between said first and second water openings;

wherein said supporting frame comprises a first blocking wall positioned adjacent to said first water inlet for blocking said water flowing from said first water inlet to said first water outlet, and a second blocking wall positioned adjacent to said second water outlet for blocking said water flowing from said second water inlet to said second water outlet;

wherein said water adapter further comprises a supporting shaft having an elongated end coupling with said first rotatable frame and a free end which is extended through said supporting frame and is coupled with said second rotatable frame such that said first and second rotatable frames are rotatably coupled with said supporting frame through said supporting shaft;

wherein said water flow diverter comprises a switch being controllably actuated at three different positions, wherein said switch is actuated at a first position to close said second water opening and to open said water exit for guiding said water only flowing out at said water exit, wherein said switch is actuated at a second position to open said second water opening and to close said water exit for guiding said water only flowing out at said second water opening so as to flow back to said water adapter, wherein said switch is actuated at a third position to open both said second water opening and said water exit for guiding said water dividedly flowing out at said water exit and said second water opening at the same time.

4. The showerhead assembly, as recited in claim 3, wherein said water adapter further comprises two shaft sleeves which are coaxially coupled with said supporting shaft and are frictionally engaged with said first and second rotatable frames respectively, wherein each of said shaft sleeves has a hollow cone shape that an outer circumferential size is gradually increasing from said supporting frame towards said respective rotatable frame to enhance a frictional engagement between said shaft sleeves and said first and second rotatable frames.

5. The showerhead assembly, as recited in claim 3, wherein said water adapter further comprises an adjusting cap is rotatably coupled with said second rotatable frame to rotatably couple with said supporting shaft for adjusting an engagement of said supporting frame between said first and second rotatable frames via said supporting shaft.

6. The showerhead assembly, as recited in claim 4, wherein said water adapter further comprises an adjusting cap is rotatably coupled with said second rotatable frame to rotatably couple with said supporting shaft for adjusting an engagement of said supporting frame between said first and second rotatable frames via said supporting shaft.

7. The showerhead assembly, as recited in claim 6, wherein said first water conduit comprises a first straight water duct coupling with said first water outlet, a first angled water duct coupling with said first straight water duct, and a first connector head which is coupling with said first angled water duct and is rotatably coupled at said first water opening, wherein said second water conduit comprises a second straight water duct coupling with said second water inlet, a second angled water duct coupling with said second straight water duct, and a second connector head which is coupling with said second angled water duct and is rotatably coupled at said second water opening.

8. A showerhead assembly, comprising:

a water adapter comprising a supporting frame having a first water inlet for detachably coupling with a water source and a second water outlet for coupling with a stationary showerhead, first and second rotatable frames rotatably coupling with two end sides of said supporting frame, wherein said first rotatable frame has a first water outlet communicating with said first water inlet for guiding a water flowing from said first water inlet to said first water outlet, wherein said second rotatable frame has a second water inlet communicating with said second water outlet for guiding said water flowing from said second water inlet to said second water outlet;

first and second water conduits, wherein said first water conduit has one end communicatively coupling with said first water outlet, wherein said second water conduit has one end communicatively coupling with said second water outlet; and a water flow diverter containing a first water opening communicatively coupling with an opposed end of said first water conduit for guiding said water flowing from said water adapter to said water flow diverter through said first water conduit, a second water opening communicatively coupling with an opposed end of said second water conduit for guiding said water flowing back to said water adapter from said water flow diverter through said second water conduit, and a water exit communicating with said first water opening for coupling with an adjustable showerhead, wherein said water flow diverter is adapted for selectively controlling said water flowing out from at least one of said stationary showerhead and said adjustable showerhead;

wherein said water adapter further comprises a supporting shaft having an elongated end coupling with said first rotatable frame and a free end which is extended through said supporting frame and is coupled with said second rotatable frame such that said first and second rotatable frames are rotatably coupled with said supporting frame through said supporting shaft;

wherein said water adapter further comprises two shaft sleeves which are coaxially coupled with said supporting shaft and are frictionally engaged with said first and second rotatable frames respectively, wherein each of said shaft sleeves has a hollow cone shape that an outer circumferential size is gradually increasing from said supporting frame towards said respective rotatable frame to enhance a frictional engagement between said shaft sleeves and said first and second rotatable frames.

* * * * *